US009786245B2

(12) United States Patent
Lee et al.

(10) Patent No.: US 9,786,245 B2
(45) Date of Patent: Oct. 10, 2017

(54) METHOD OF GENERATING DRIVING VOLTAGE FOR DISPLAY PANEL AND DISPLAY APPARATUS PERFORMING THE METHOD

(71) Applicant: Samsung Display Co., LTD., Yongin, Gyeonggi-Do (KR)

(72) Inventors: Yo-Han Lee, Asan-si (KR); Hyang-A Park, Incheon (KR); Sun-Kyo Lim, Seoul (KR); In-Cheol Jeong, Yeongju-si (KR)

(73) Assignee: Samsung Display Co., Ltd. (KR)

( * ) Notice: Subject to any disclaimer, the term of this patent is extended or adjusted under 35 U.S.C. 154(b) by 210 days.

(21) Appl. No.: 14/575,540

(22) Filed: Dec. 18, 2014

(65) Prior Publication Data

US 2015/0194118 A1 Jul. 9, 2015

(30) Foreign Application Priority Data

Jan. 7, 2014 (KR) ..... 10-2014-0001758

(51) Int. Cl.
*G09G 3/36* (2006.01)

(52) U.S. Cl.
CPC ..... *G09G 3/3688* (2013.01); *G09G 3/3696* (2013.01); *G09G 2320/0209* (2013.01); *G09G 2320/0247* (2013.01); *G09G 2330/021* (2013.01); *G09G 2340/0435* (2013.01)

(58) Field of Classification Search
CPC ..... G09G 2320/02; G09G 2320/00; G09G 2320/0247; G09G 2330/021; G09G 2330/022; G09G 2330/00; G09G 2340/0435; G09G 2340/0407; G09G 2340/04; G09G 2340/00; G09G 3/3688; G09G 3/3696; G09G 3/3685; G09G 3/3611; G09G 3/36; G09G 3/34; G09G 3/2092; G09G 3/20; G09G 3/00
See application file for complete search history.

(56) References Cited

U.S. PATENT DOCUMENTS

| | | | | |
|---|---|---|---|---|
| 7,002,531 | B2 * | 2/2006 | Koike | G06F 3/147 345/3.1 |
| 7,603,575 | B2 | 10/2009 | Woodbridge et al. | |
| 7,913,071 | B2 * | 3/2011 | Mallik | G06F 1/3203 455/127.5 |
| 8,289,312 | B2 * | 10/2012 | Matsuda | G09G 3/3677 345/213 |
| 9,501,987 | B2 * | 11/2016 | Oh | G09G 3/3655 |

(Continued)

FOREIGN PATENT DOCUMENTS

| | | |
|---|---|---|
| JP | 3542978 | 7/2004 |
| JP | 4356946 | 11/2009 |
| KR | 10-2013-0085736 | 7/2013 |

*Primary Examiner* — Julie Anne Watko
(74) *Attorney, Agent, or Firm* — Innovation Counsel LLP

(57) ABSTRACT

A method of generating a driving voltage which drives a display panel, includes storing a driving voltage data corresponding to a driving frequency of the display panel in a memory, obtaining a frequency signal corresponding to the driving frequency of the display panel, reading out driving voltage data corresponding to the driving frequency of the display panel from the memory according to the frequency signal, and generating a driving voltage of the display panel based on the driving voltage data stored in the memory.

19 Claims, 5 Drawing Sheets

(56) References Cited

U.S. PATENT DOCUMENTS

| | | | | |
|---|---|---|---|---|
| 2004/0104874 | A1* | 6/2004 | Monomohshi | G09G 3/2011 345/87 |
| 2004/0196274 | A1* | 10/2004 | Song | G09G 3/2011 345/204 |
| 2009/0089725 | A1* | 4/2009 | Khan | G01R 31/31721 716/106 |
| 2012/0162184 | A1* | 6/2012 | Kim | G09G 3/3655 345/212 |
| 2013/0113776 | A1 | 5/2013 | Ding et al. | |
| 2013/0151871 | A1 | 6/2013 | Huynh | |
| 2014/0092077 | A1* | 4/2014 | Kim | G09G 3/3611 345/212 |
| 2014/0176526 | A1* | 6/2014 | Oh | G09G 3/3611 345/212 |
| 2014/0192096 | A1* | 7/2014 | Maruyama | G09G 3/3666 345/690 |
| 2015/0054809 | A1* | 2/2015 | Lim | G09G 3/3696 345/211 |
| 2017/0053592 | A1* | 2/2017 | Shin | G06F 3/011 |
| 2017/0059910 | A1* | 3/2017 | Fukai | G09G 3/3677 |
| 2017/0148390 | A1* | 5/2017 | Park | G09G 3/3258 |

* cited by examiner

METHOD OF GENERATING DRIVING VOLTAGE FOR DISPLAY PANEL AND DISPLAY APPARATUS PERFORMING THE METHOD

This application claims priority to and the benefit of Korean Patent Application No. 10-2014-0001758 filed on Jan. 7, 2014, which is hereby incorporated by reference for all purposes as if fully set forth herein.

BACKGROUND

1. Field

Exemplary embodiments of the present inventive concept relate to a method of generating a driving voltage for a display panel and a display apparatus performing the method. More particularly, example embodiments of the present inventive concept relate to a method of a generating a driving voltage for improving a display quality and a display apparatus performing the method.

2. Description of the Related Art

Generally, a liquid crystal display ("LCD") device includes an LCD panel that displays an image using a light-transmitting ratio of liquid crystal molecules, and a backlight assembly disposed below the LCD panel to provide the LCD panel with light.

The LCD device includes a display panel in which a plurality of pixel parts connected to gate lines and data lines crossing the gate lines are formed, a gate drive circuit outputting a gate signal to the gate lines, and a data drive circuit outputting a data signal to the data lines. The gate drive circuit and the data drive circuit may be formed in an IC chip and attached on the display panel, or may be formed on the display panel directly. A pixel includes a pixel electrode and a thin film transistor. The thin film transistor is connected to a data line, a gate line and the pixel electrode, and drives the pixel electrode.

The LCD device further includes a driving voltage generation circuit. The driving voltage generation circuit generates a plurality of driving voltages which drives a data driver circuit, a gate driver circuit and a LCD panel.

BRIEF SUMMARY OF THE INVENTION

Exemplary embodiments of the present inventive concept provide a method of generating a driving voltage synchronized with a driving frequency of a display panel.

Exemplary embodiments of the present inventive concept provide a display apparatus performing the method of generating the driving voltage.

According to an exemplary embodiment of the inventive concept, there is provided a method of generating a driving voltage which drives a display panel. The method includes storing a driving voltage data corresponding to a driving frequency of the display panel in a memory, obtaining a frequency signal corresponding to the driving frequency of the display panel, reading out driving voltage data corresponding to the driving frequency of the display panel from the memory according to the frequency signal; and generating a driving voltage of the display panel based on the driving voltage data stored in the memory.

In an exemplary embodiment, the driving voltage may include a gate on voltage and a gate off voltage which are applied to a gate driver circuit configured to drive a gate line of the display panel, an analog source voltage which is applied to a data driver circuit configured to drive a data line of the display panel.

In an exemplary embodiment, the method may further include when the driving voltage data of the driving frequency are not in the memory, reading out driving voltage data of an approximate frequency, and generating a driving voltage using the driving voltage data of the approximate frequency.

In an exemplary embodiment, the method may further include reading out ripple compensation data corresponding to the driving frequency from the memory according to the frequency signal, and compensating a ripple of the driving voltage based on the ripple compensation data.

In an exemplary embodiment, the method may further include when the driving voltage data of the driving frequency are not in the memory, reading out of driving voltage data of approximate frequencies from the memory, calculating an incremental value using a proportional expression, and calculating the driving voltage data of the driving frequency using the incremental value. The driving voltage is generated using calculated driving voltage data.

In an exemplary embodiment, the method may further include reading out ripple compensation data corresponding to the driving frequency from the memory according to the frequency signal and compensating a ripple of the driving voltage based on the ripple compensation data.

In an exemplary embodiment, the ripple compensation data may be configured to compensate a ripple of the analog source voltage.

In an exemplary embodiment, the method may further include when the driving voltage data of the driving frequency are not in the memory, reading out ripple compensation data of an approximate frequency to the driving frequency from the memory, wherein the ripple of the driving voltage is compensated using the ripple compensation data of the approximate frequency.

In an exemplary embodiment, the method may further include when the driving voltage data of the driving frequency are not in the memory, reading out ripple compensation data of approximate frequencies from the memory, calculating an incremental value using a proportional expression, and calculating the ripple compensation data of the driving frequency using the incremental value, wherein the ripple of the driving voltage is compensated using calculated ripple compensation data.

According to an exemplary embodiment of the inventive concept, there is provided a display apparatus. The display apparatus includes a display panel comprising a liquid crystal capacitor which is connected to a data line and a gate line through a thin film transistor, a timing control circuit configured to obtain a frequency signal corresponding to a driving frequency of the display panel based on an original control signal, a memory configured to store driving voltage data corresponding to a plurality of driving frequencies, and a power management circuit configured to generate a driving voltage of the display panel based the driving voltage data of the driving frequency.

In an exemplary embodiment, the power management circuit and the memory are integrated into one chip.

In an exemplary embodiment, when the driving voltage data of the driving frequency are not in the memory, the power management circuit is configured to read out driving voltage data of an approximate frequency from the memory and to generate the driving voltage based on the driving voltage data of the approximate frequency.

In an exemplary embodiment, when the driving voltage data of the driving frequency are not in the memory, the power management circuit is configured to read out driving voltage data of approximate frequencies from the memory, to calculate an incremental value using a proportional expression, to calculate the driving voltage data of the driving frequency using the incremental value, and to generate the driving voltage based on calculated driving voltage data.

In an exemplary embodiment, the memory may be configured to store ripple compensation data which are configured to compensate a ripple of a driving voltage corresponding to a plurality of driving frequencies.

In an exemplary embodiment, the power management circuit may be configured to compensate the ripple of the driving voltage using the ripple compensation data of the driving frequency in the memory according to the frequency signal.

In an exemplary embodiment, the ripple compensation data may be configured to compensate the ripple of the analog source voltage.

In an exemplary embodiment, when the driving voltage data of the driving frequency are not in the memory, the power management circuit may be configured to read out ripple compensation data of an approximate frequency from the memory and to compensate the ripple of the driving voltage based on the ripple compensation data of the approximate frequency.

In an exemplary embodiment, when the driving voltage data of the driving frequency are not in the memory, the power management circuit is configured to read out ripple compensation data of approximate frequencies from the memory, to calculate an incremental value using a proportional expression, to calculate the ripple compensation data of the driving frequency using the incremental value, and to compensate the ripple of the driving voltage based on calculated ripple compensation data.

In an exemplary embodiment, the memory and the timing control circuit are integrated into one chip.

According to the present inventive concept, the display panel is driven with the driving voltages which are synchronized with the driving frequency of the display panel. In addition, the ripple of the driving voltage may be optimally compensated in synchronization with the driving frequency. Therefore, when the display apparatus is driven with a low frequency in order to decrease power consumption, a display quality of an image may be improved.

BRIEF DESCRIPTION OF THE DRAWINGS

The above and other features and advantages of the present inventive concept will become more apparent by describing in detailed exemplary embodiments thereof with reference to the accompanying drawings, in which.

DETAILED DESCRIPTION OF THE INVENTION

Hereinafter, the present inventive concept will be explained in detail with reference to the accompanying drawings.

Figure 1:
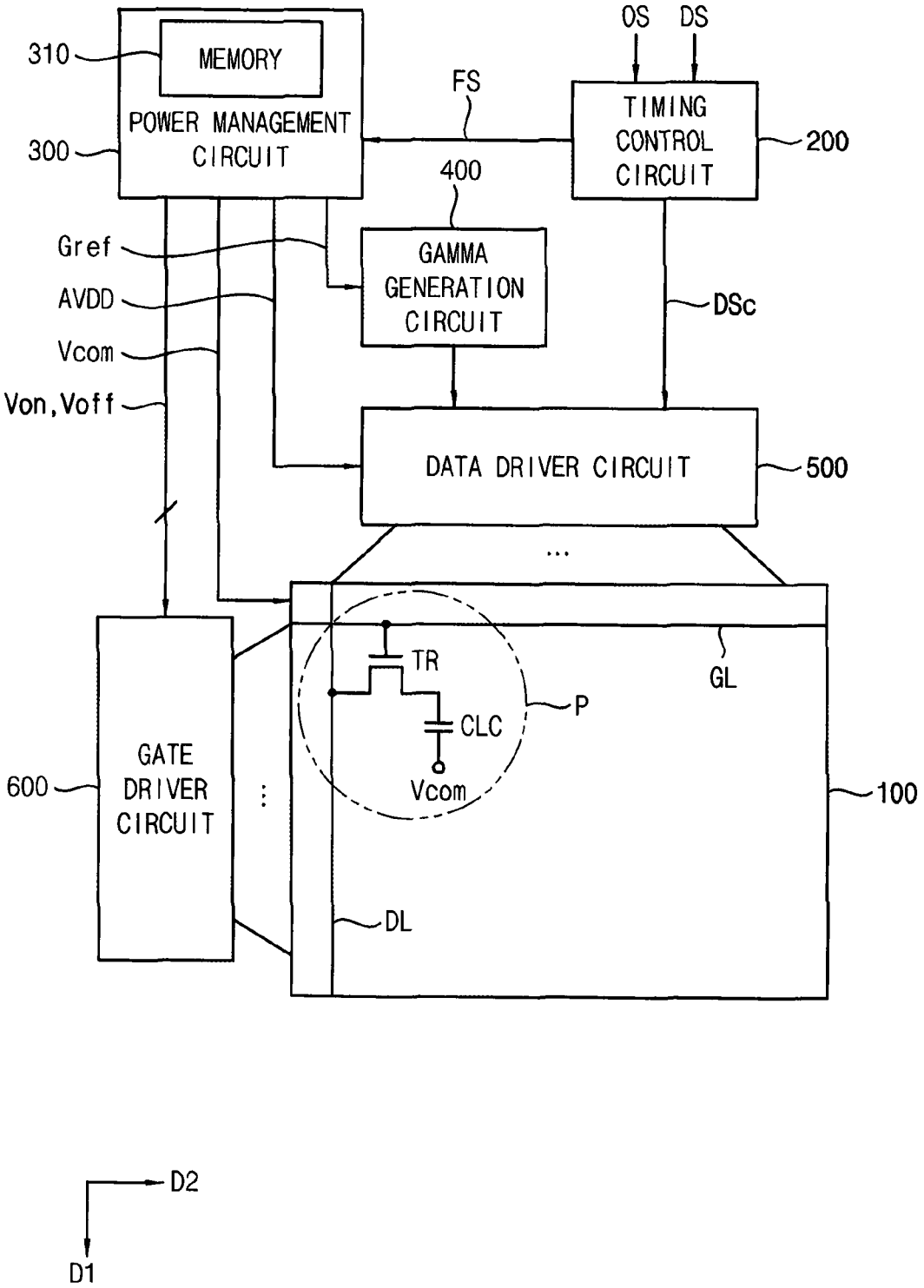
FIG. 1 is a block diagram illustrating a display apparatus according to an exemplary embodiment.
Figure 2:
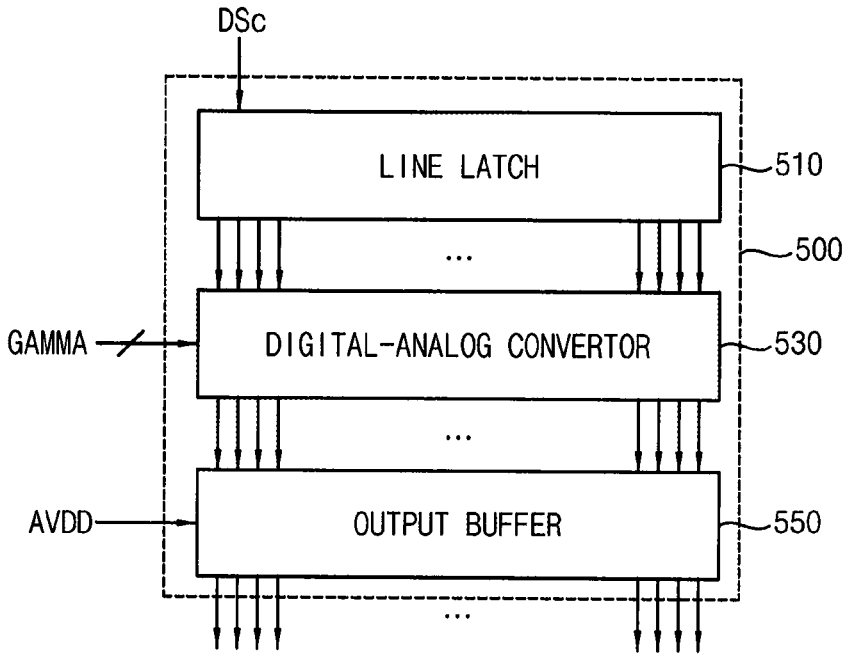
FIG. 2 is a block diagram illustrating a data drive circuit of FIG. 1.

FIG. 1 is a block diagram illustrating a display apparatus according to an exemplary embodiment. FIG. 2 is a block diagram illustrating a data drive circuit of FIG. 1.

Referring to FIGS. 1 and 2, the display apparatus may include a display panel 100, a timing control circuit 200, a power management circuit 300, a gamma generation circuit 400, a data driver circuit 500 and a gate driver circuit 600.

The display panel 100 may include a plurality of data lines DL, a plurality of gate lines GL and a plurality of pixels P. The data lines DL extend in a first direction D1 and are arranged in a second direction D2 crossing the first direction D1. The gate lines GL extend in the second direction D2 and are arranged in the first direction D1. The pixels P include a thin film transistor TR and a liquid crystal capacitor CLC. The thin film transistor TR is connected to a data line DL, a gate line GL and a first electrode of the liquid crystal capacitor CLC. The first electrode of the liquid crystal capacitor CLC is a pixel electrode which is configured to receive a data signal through the data line. A second electrode of the liquid crystal capacitor CLC is a common electrode which is configured to receive a common voltage VCOM. The liquid crystal capacitor CLC includes a liquid crystal layer which is disposed between the first and second electrode.

The timing control circuit 200 is configured to receive an original control signal OS and a data signal DS.

The timing control circuit 200 is configured to determine a driving frequency of the display panel 100 based on the original control signal OS. The timing control circuit 200 is configured to provide the power management circuit 300 with a frequency signal FS corresponding to the driving frequency.

In addition, the timing control circuit 200 is configured to generate a plurality of timing signals based on the original control signal OS. The timing signals may include a data timing signal which is configured to drive the data driver circuit 500 and a gate timing signal which is configured to drive the gate driver circuit 600. The data timing signal may include a vertical synch signal, a horizontal synch signal, a data clock signal, and a load signal and so on. The gate timing signal may include at least one vertical start signal, at least one clock control signal and so on.

The timing control circuit 200 is configured to correct the data signal DS through various compensation algorithms and to provide the data driver circuit 500 with corrected data signal DSc.

The power management circuit 300 includes a memory 310. The power management circuit 300 is configured to generate a plurality of driving voltages using data stored in the memory 310. The power management circuit 300 and the memory 310 may be combined into one IC chip. Although not shown in figures, the memory 310 may be separated from the power management circuit 300. Alternatively, the memory 310 is included in the timing control circuit 200 and thus the memory 310 and the timing control circuit 200 may be combined into one chip IC.

The driving voltages may include a common voltage Vcom which is configured to be applied to the display panel 100, an at least one reference gamma voltage Gref which is configured to be applied to the gamma generation circuit 400, an analog source voltage AVDD which is configured to be applied to the data driver circuit 500 and a gate on voltage Von and a gate off voltage Voff which are configured to be applied to the gate driver circuit 600.

The memory 310 is configured to store driving voltage data optimized respectively corresponding to a plurality of driving frequencies of a display panel. Optimal driving voltage data may be different according to a driving characteristic of the liquid crystal, and thus may be obtained through experiment or simulation.

For example, as the following Table 1, the memory 310 may store driving voltage data respectively corresponding to a plurality of driving frequencies.

TABLE 1

| | 30 Hz | 50 Hz | 60 Hz | . . . |
|---|---|---|---|---|
| Von | 18 V | 19 V | 20 V | . . . |
| Voff | −6.5 V | −6.5 V | −6.5 V | . . . |
| AVDD | 8.5 V | 8.0 V | 7.5 V | . . . |
| Vocm | 4.2 V | 4.0 V | 3.8 V | . . . |
| . . . | . . . | . . . | . . . | . . . |

The power management circuit 300 is configured to read out driving voltage data corresponding to the driving frequency of the display panel 100 from the memory 310 based on the frequency signal FS received from the timing control circuit 200, and to generate the plurality of driving voltages based on the driving voltage data stored in the memory 310.

The gamma generation circuit 400 is configured to generate a plurality of gamma voltage using the reference gamma voltage Gref among the driving voltages. The plurality of gamma voltages is applied to the data driver circuit 500.

The data driver circuit 500 is configured to convert the corrected data signal DSc to a data voltage using the plurality of gamma voltages and the analog source voltage AVDD among the driving voltages, and to provide the data line DL of the display panel 100 with the data voltage.

As shown in FIG. 2, the data driver circuit 500 may include a line latch 510, a digital-analog convertor 530 and an output buffer 550.

The line latch 510 is configured to latch the data signal received from the timing control circuit 200 by a horizontal line. The line latch 510 is configured to output the data signal in response to the load signal received from the timing control circuit 200.

The digital-analog convertor 530 is configured to convert the data signal received from the line latch 510 to the data voltage corresponding to a grayscale using the plurality of gamma voltages GAMMA.

The output buffer 550 includes a plurality of amplifiers which is driven by the analog source voltage AVDD. The output buffer 550 is configured to amplify the data voltage and to output the data voltage to the data line DL of the display panel 100. The output buffer 550 is configured to output the data voltage by 1 horizontal period.

The gate driver circuit 600 is configured to generate a plurality of gate signals using the gate on voltage Von and the gate off voltage Voff and to sequentially output the plurality of gate signals to the gate line GL of the display panel 100.

The driving characteristic of the liquid crystal is different according to the driving frequency of the display panel 100. Thus, according to such exemplary embodiment, the display panel 100 may be driven by an optimal driving voltage corresponding to the driving frequency of the display panel 100 such that a display defect such as crosstalk, flicker and so on may be prevented.

Figure 3:
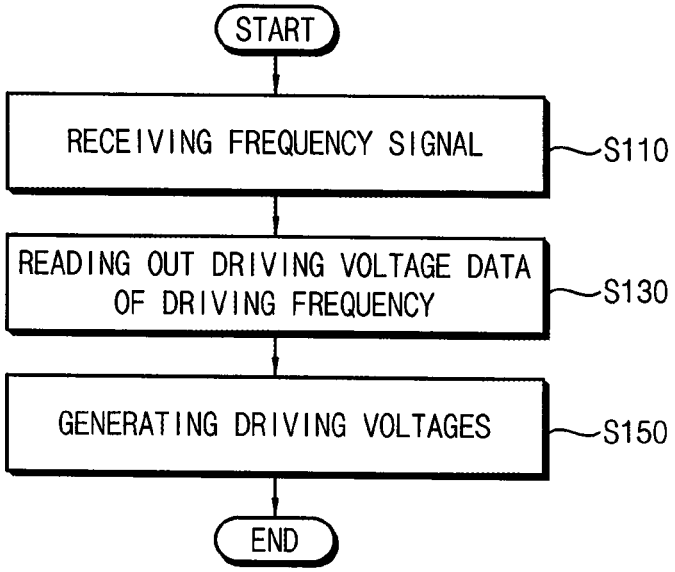
FIG. 3 is a flowchart illustrating a method of generating a driving voltage of a display panel of FIG. 1.

FIG. 3 is a flowchart illustrating a method of generating a driving voltage of a display panel of FIG. 1.

Referring to FIGS. 1 and 3, the display apparatus may be driven with a low frequency lower than a normal frequency in order to decrease power consumption. The power management circuit 300 includes the memory 310 which is configured to store driving voltage data respectively corresponding to the normal frequency and at least one low frequency.

When the display apparatus is turned-on, the timing control circuit 200 is configured to obtain a frequency information of the display panel 100 based on the original control signal OS.

The timing control circuit 200 is configured to provide the power management circuit 300 with a frequency signal FS corresponding to the frequency information.

The power management circuit 300 is configured to receive the frequency signal FS (Step S110).

The power management circuit 300 is configured to read out driving voltage data corresponding to the driving frequency of the display panel 100 from the memory 310 based on the frequency signal FS (Step S130).

The power management circuit 300 is configured to generate the driving voltages Von, Voff, Vcom, AVDD and Gref using the driving voltage data (Step S150).

Therefore, the at least one reference gamma voltage Gref is configured to be applied to the gamma generation circuit 400. The gamma generation circuit 400 is configured to generate a plurality of gamma voltages GAMMA using the at least one reference gamma voltage Gref. The plurality of gamma voltages GAMMA is configured to be applied to the digital-analog convertor 530 of the data driver circuit 500. The analog source voltage AVDD is configured to be applied to the output buffer 550 of the data driver circuit 500. The data driver circuit 500 is configured to generate the data voltage using the driving voltage Gref and AVDD and to provide the data line DL of the display panel 100 with the data voltage.

The gate on voltage Von and the gate off voltage Voff are configured to be applied to the gate driver circuit 600. The gate driver circuit 600 is configured to generate a plurality of gate signals using the gate on voltage Von and the gate off voltage Voff. The gate driver circuit 600 is configured to sequentially provide the gate line GL of the display panel 100 with the plurality of gate signals.

The common voltage Vcom is configured to be applied to the display panel 100. The common voltage Vcom is applied to the common electrode that is the second electrode of the liquid crystal capacitor CLC.

As described above, the display panel 100 is driven by the driving voltages Von, Voff, Vcom, AVDD and Gref in synchronization with the driving frequency of the display panel 100 such that a display quality of display panel 100 may be improved.

Figure 4:
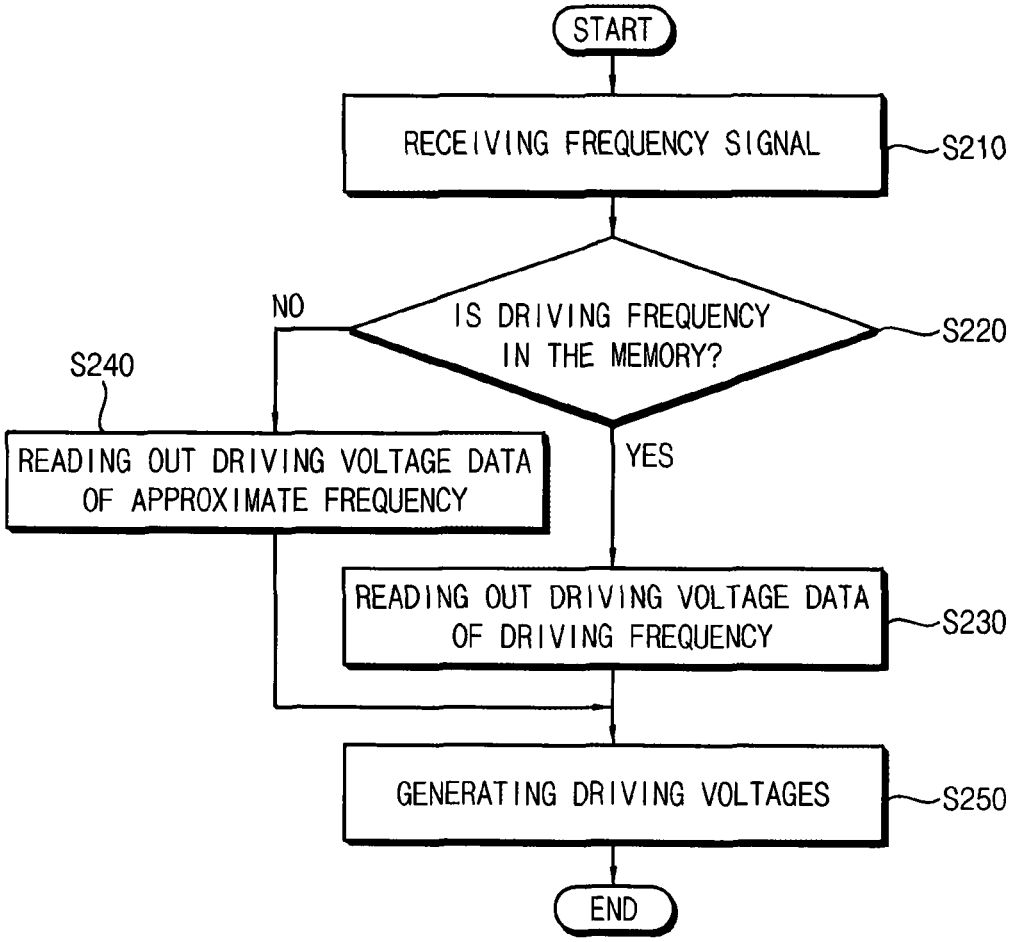
FIG. 4 is a flowchart illustrating a method of generating a driving voltage of a display panel according to an exemplary embodiment.

FIG. 4 is a flowchart illustrating a method of generating a driving voltage of a display panel according to an exemplary embodiment.

Referring to FIGS. 1 and 4, when the display apparatus is turned-on, the timing control circuit 200 is configured to obtain a frequency information of the display panel 100 based on the original control signal OS.

The timing control circuit 200 is configured to provide the power management circuit 300 with a frequency signal FS corresponding to the frequency information.

The power management circuit 300 is configured to receive the frequency signal FS (Step S210).

The power management circuit 300 is configured to determine whether driving voltage data corresponding to the driving frequency of the display panel is in the memory 310, based on the frequency signal FS (Step S220).

When driving voltage data corresponding to the driving frequency of the display panel is in the memory 310, the power management circuit 300 is configured to read out the driving voltage data of the driving frequency from the memory 310 (Step S230).

The power management circuit 300 is configured to generate the driving voltages Von, Voff, Vcom, AVDD and Gref using the driving voltage data of the driving frequency (Step S250).

In the (Step S220), when driving voltage data corresponding to the driving frequency of the display panel is not in the memory 310, the power management circuit 300 is configured to read out driving voltage data of an approximate frequency to the driving frequency from the memory 310 (Step S240).

For example, when the memory 310 is configured to store driving voltage data respectively corresponding to 30 Hz, 40 Hz and 60 Hz, the driving frequency of the display panel is 34 Hz, the power management circuit 300 is configured to read out driving voltage data of an approximate frequency (30 Hz) to the driving frequency (34 Hz) from the memory 310.

The power management circuit 300 is configured to generate the driving voltages Von, Voff, Vcom, AVDD and Gref using the driving voltage data of the approximate frequency (Step S250).

Therefore, the at least one reference gamma voltage Gref is configured to be applied to the gamma generation circuit 400. The gamma generation circuit 400 is configured to generate a plurality of gamma voltages GAMMA using the at least one reference gamma voltage Gref. The plurality of gamma voltages GAMMA is configured to be applied to the digital-analog convertor 530 of the data driver circuit 500. The analog source voltage AVDD is configured to be applied to the output buffer 550 of the data driver circuit 500. The data driver circuit 500 is configured to generate the data voltage using the driving voltage Gref and AVDD and to provide the data line DL of the display panel 100 with the data voltage.

The gate on voltage Von and the gate off voltage Voff are configured to be applied to the gate driver circuit 600. The gate driver circuit 600 is configured to generate a plurality of gate signals using the gate on voltage Von and the gate off voltage Voff. The gate driver circuit 600 is configured to sequentially provide the gate line GL of the display panel 100 with the plurality of gate signals.

The common voltage Vcom is configured to be applied to the display panel 100. The common voltage Vcom is applied to the common electrode that is the second electrode of the liquid crystal capacitor CLC.

As described above, the display panel 100 is driven by the driving voltages Von, Voff, Vcom, AVDD and Gref in synchronization with the driving frequency of the display panel 100 such that a display quality of display panel 100 may be improved.

Figure 5:
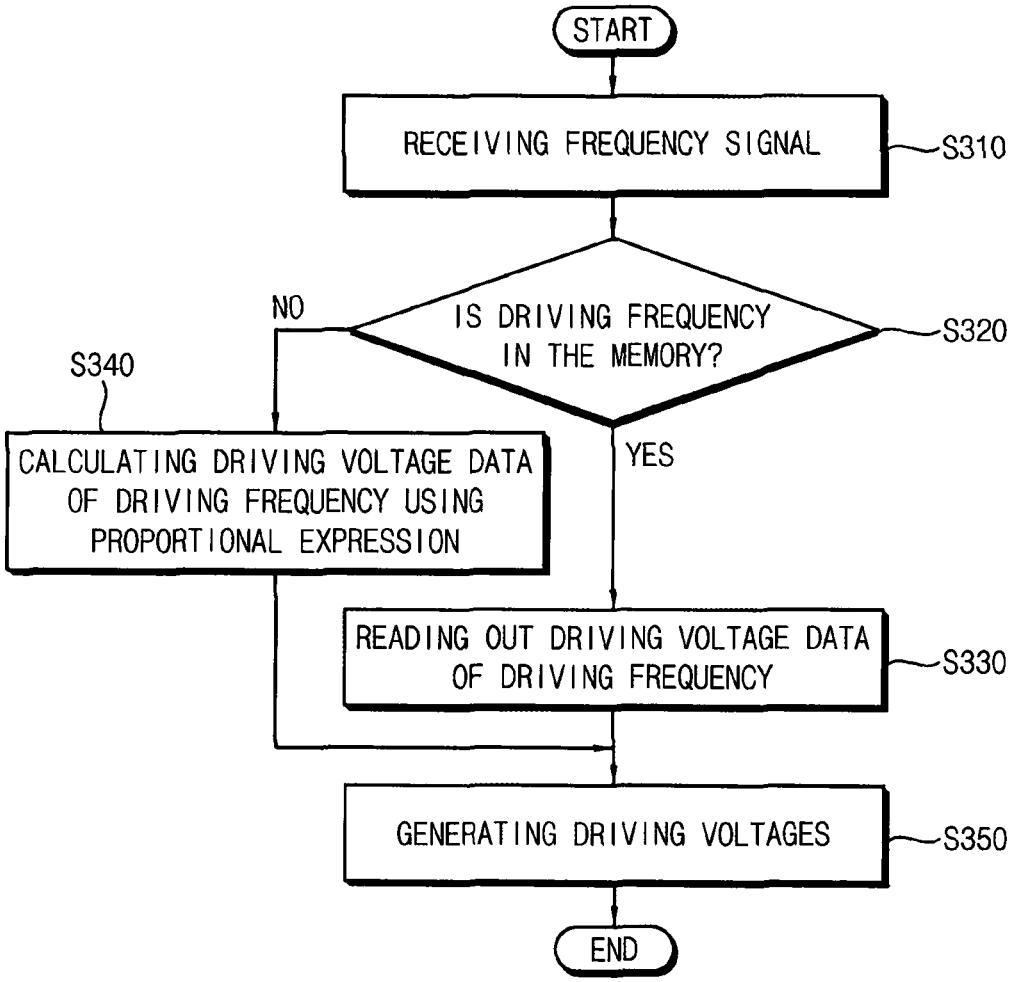
FIG. 5 is a flowchart illustrating a method of generating a driving voltage of a display panel according to an exemplary embodiment.

FIG. 5 is a flowchart illustrating a method of generating a driving voltage of a display panel according to an exemplary embodiment.

Referring to FIG. 5, when the display apparatus is turned-on, the timing control circuit 200 is configured to obtain a frequency information of the display panel 100 based on the original control signal OS.

The timing control circuit 200 is configured to provide the power management circuit 300 with a frequency signal FS corresponding to the frequency information.

The power management circuit 300 is configured to receive the frequency signal FS (Step S310).

The power management circuit 300 is configured to determine whether driving voltage data corresponding to the driving frequency of the display panel is in the memory 310, based on the frequency signal FS (Step S320).

When driving voltage data corresponding to the driving frequency of the display panel is in the memory 310, the power management circuit 300 is configured to read out the driving voltage data of the driving frequency from the memory 310 (Step S330).

The power management circuit 300 is configured to generate the driving voltages Von, Voff, Vcom, AVDD and Gref using the driving voltage data of the driving frequency (Step S350).

In the (Step S320), when driving voltage data corresponding to the driving frequency of the display panel is not in the memory 310, the power management circuit 300 is configured to read out driving voltage data of approximate frequencies from the memory 310 and calculate an incremental value using a proportional expression (Step S340).

For example, when the memory 310 is configured to store driving voltage data respectively corresponding to 30 Hz, 40 Hz and 60 Hz, the driving frequency of the display panel is 34 Hz, the power management circuit 300 is configured to read out driving voltage data of approximate frequencies (30 Hz and 50 Hz) from the memory 310 and calculate a driving voltage of 34 Hz using a proportional expression. For example, the driving voltage, Von, of 34 Hz is calculated using a driving voltage of 30 Hz and a driving voltage of 50 Hz which are approximate frequencies of 34 Hz. The driving voltage, Von, of 34 Hz is calculated as follows:

Von=18 V+{(19V−18V)*(34 Hz−30 Hz)/(50 Hz−30 Hz)}=18.2 V. The power management circuit 300 is configured to generate the driving voltages Von, Voff, Vcom, AVDD and Gref using the driving voltage data calculated by the proportional expression (Step S350).

Therefore, the at least one reference gamma voltage Gref is configured to be applied to the gamma generation circuit 400. The gamma generation circuit 400 is configured to generate a plurality of gamma voltages GAMMA using the at least one reference gamma voltage Gref. The plurality of gamma voltages GAMMA is configured to be applied to the digital-analog convertor 530 of the data driver circuit 500. The analog source voltage AVDD is configured to be applied to the output buffer 550 of the data driver circuit 500. The data driver circuit 500 is configured to generate the data voltage using the driving voltage Gref and AVDD and to provide the data line DL of the display panel 100 with the data voltage.

The gate on voltage Von and the gate off voltage Voff are configured to be applied to the gate driver circuit 600. The gate driver circuit 600 is configured to generate a plurality of gate signals using the gate on voltage Von and the gate off voltage Voff. The gate driver circuit 600 is configured to sequentially provide the gate line GL of the display panel 100 with the plurality of gate signals.

The common voltage Vcom is configured to be applied to the display panel 100. The common voltage Vcom is applied to the common electrode that is the second electrode of the liquid crystal capacitor CLC.

As described above, the display panel 100 is driven by the driving voltages Von, Voff, Vcom, AVDD and Gref in synchronization with the driving frequency of the display panel 100. Therefore, the display apparatus may be driven with a low frequency in order to decrease power consumption, even in that case, the display quality may be improved.

Figure 6:
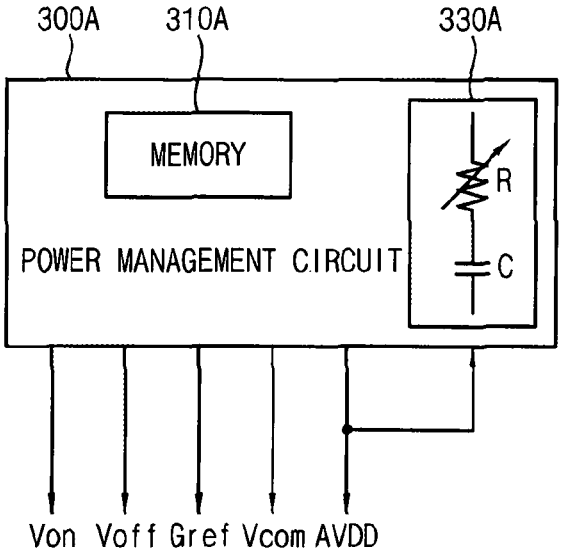
FIG. 6 is a block diagram illustrating a power management circuit according to an exemplary embodiment.

FIG. 6 is a block diagram illustrating a power management circuit according to an exemplary embodiment.

In an exemplary embodiment, the display apparatus includes the same or like parts as remaining parts except for the power management circuit among those described in the previous exemplary embodiment of FIG. 1. Hereinafter, the same reference numerals are used to refer to the same or like parts as those described in the previous exemplary embodiments, and the same detailed explanations are not repeated unless necessary.

Referring to FIGS. 1, 2 and 6, the power management circuit 300A may include a memory 310A and a ripple compensation part 330A. The power management circuit 300A is configured to generate a plurality of driving voltages.

The power management circuit 300A and the memory 310A may be combined into one IC chip. Although not shown in figures, the memory 310A may be separated from the power management circuit 300A. Alternatively, the memory 310A is included in the timing control circuit 200 and thus the memory 310A and the timing control circuit 200 may be combined into one IC chip.

The ripple compensation part 330A may include in the power management circuit 300A, or may be separated from the power management circuit 300A.

The plurality of driving voltages may include a common voltage Vcom which is configured to be applied to the display panel 100, an at least one reference gamma voltage Gref which is configured to be applied to the gamma generation circuit 400, an analog source voltage AVDD which is configured to be applied to the data driver circuit 500 and a gate on voltage Von and a gate off voltage Voff which are configured to be applied to the gate driver circuit 600.

The memory 310A is configured to store driving voltage data optimized respectively corresponding to a plurality of driving frequencies of a display panel.

In addition, the memory 310A is configured to store ripple compensation data which compensate a ripple of the analog source voltage AVDD among the driving voltage. The ripple compensation data are for compensating a slope of the ripple by the driving frequency to be gentle. The ripple compensation data may be obtained through experiment or simulation.

For example, as the following Table 2, the memory 310A may store driving voltage data and ripple compensation data respectively corresponding to a plurality of driving frequencies.

TABLE 2

| | 30 Hz | 50 Hz | 60 Hz | . . . |
|---|---|---|---|---|
| Von | 18 V | 19 V | 20 V | . . . |
| Voff | −6.5 V | −6.5 V | −6.5 V | . . . |
| AVDD | 8.5 V | 8.0 V | 7.5 V | . . . |
| Vocm | 4.2 V | 4.0 V | 3.8 V | . . . |

TABLE 2-continued

| | 30 Hz | 50 Hz | 60 Hz | . . . |
|---|---|---|---|---|
| Ripple compensation | A | B | C | . . . |

The power management circuit 300A is configured to read out driving voltage data and ripple compensation data corresponding to the driving frequency of the display panel 100 from the memory 310A based on the frequency signal FS received from the timing control circuit 200, and to generate the plurality of driving voltages based on the driving voltage data.

The power management circuit 300A is configured to generate a plurality of driving voltages using the driving voltage data. In addition, the power management circuit 300A is configured to control the ripple compensation part 330A based on the ripple compensation data.

The ripple compensation part 330A includes a capacitor and a variable resistor. The variable resistor may have a variable resistance corresponding to the driving frequency based on the ripple compensation data.

Therefore, the ripple compensation part 330A is configured to compensate the ripple of the analog source voltage AVDD fed back from the data driver circuit based on the ripple compensation data optimized according to the driving frequency.

Referring to FIG. 2, the analog source voltage AVDD is configured to be applied to the output buffer 550 of the data driver circuit 500. The output buffer 550 is configured to output the data voltage to the data line DL of the display panel 100 by a horizontal period. Thus, the analog source voltage AVDD includes the ripple which is dropped at an output timing of the output buffer 550. The horizontal period is changed according to the driving frequency of the display panel 100 such that the ripple of the analog source voltage AVDD is different according to the driving frequency.

Therefore, the ripple compensation data are set in order to optimally compensate the ripple according to the driving frequency such that the ripple of the analog source voltage AVDD may be compensated using the ripple compensation data.

According to such exemplary embodiment, the display panel 100 is driven by the driving voltages Von, Voff, Vcom, AVDD and Gref in synchronization with the driving frequency of the display panel 100. In addition, the ripple of the driving voltage may be optimally compensated based on the driving frequency. Therefore, the display apparatus may be driven with a low frequency in order to decrease power consumption, even in that case, the display quality may be improved.

Figure 7:
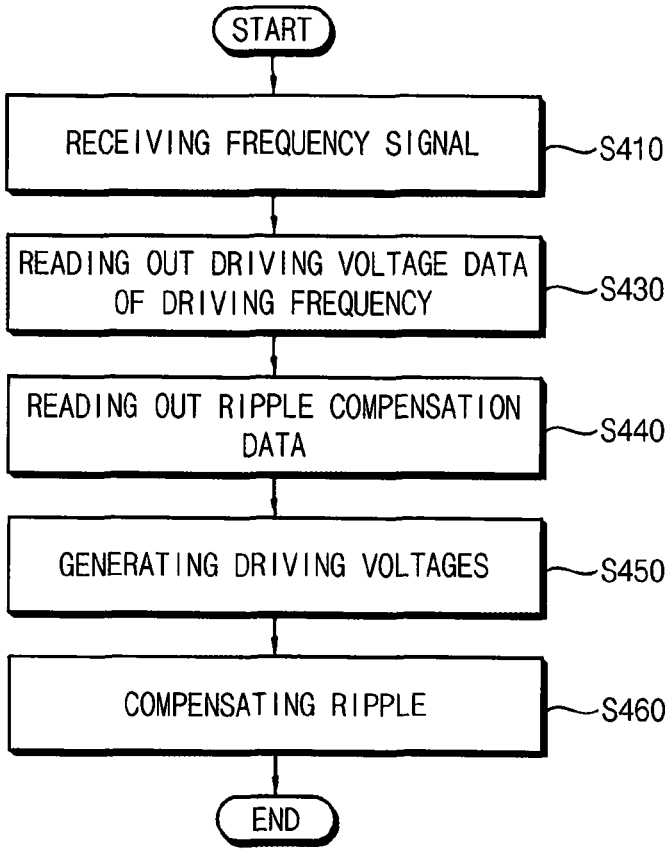
FIG. 7 is a flowchart illustrating a method of generating a driving voltage according to the power management circuit of FIG. 6.

FIG. 7 is a flowchart illustrating a method of generating a driving voltage according to the power management circuit of FIG. 6.

Referring to FIGS. 1, 6 and 7, the display apparatus may be driven with a low frequency lower than a normal frequency in order to decrease power consumption. The power management circuit 300A includes the memory 310A which is configured to store driving voltage data and ripple compensation data respectively corresponding to the normal frequency and at least one low frequency.

When the display apparatus is turned-on, the timing control circuit 200 is configured to obtain a frequency information of the display panel 100 based on the original control signal OS.

The timing control circuit 200 is configured to provide the power management circuit 300A with a frequency signal FS corresponding to the frequency information.

The power management circuit 300A is configured to receive the frequency signal FS (Step S410).

The power management circuit 300A is configured to read out driving voltage data corresponding to the driving frequency of the display panel 100 from the memory 310A based on the frequency signal FS (Step S430).

In addition, the power management circuit 300A is configured to read out ripple compensation data corresponding to the driving frequency of the display panel 100 from the memory 310A based on the frequency signal FS (Step S440).

The power management circuit 300A is configured to generate the driving voltages Von, Voff, Vcom, AVDD and Gref using the driving voltage data (Step S450).

The ripple compensation part 330A is configured to compensate the ripple of the analog source voltage AVDD among the driving voltages based on the ripple compensation data (Step S460).

Therefore, the at least one reference gamma voltage Gref is configured to be applied to the gamma generation circuit 400. The gamma generation circuit 400 is configured to generate a plurality of gamma voltages GAMMA using the at least one reference gamma voltage Gref. The plurality of gamma voltages GAMMA is configured to be applied to the digital-analog convertor 530 of the data driver circuit 500. The analog source voltage AVDD is configured to be applied to the output buffer 550 of the data driver circuit 500. The data driver circuit 500 is configured to generate the data voltage using the driving voltage Gref and AVDD and to provide the data line DL of the display panel 100 with the data voltage.

The gate on voltage Von and the gate off voltage Voff are configured to be applied to the gate driver circuit 600. The gate driver circuit 600 is configured to generate a plurality of gate signals using the gate on voltage Von and the gate off voltage Voff. The gate driver circuit 600 is configured to sequentially provide the gate line GL of the display panel 100 with the plurality of gate signals.

The common voltage Vcom is configured to be applied to the display panel 100. The common voltage Vcom is applied to the common electrode that is the second electrode of the liquid crystal capacitor CLC.

As described above, the display panel 100 is driven by the driving voltages Von, Voff, Vcom, AVDD and Gref in synchronization with the driving frequency of the display panel 100. In addition, the ripple of the driving voltage may be optimally compensated based on the driving frequency. Therefore, the display apparatus may be driven with a low frequency in order to decrease power consumption, even in that case, the display quality may be improved.

Although not shown in figures, when the driving frequency does not store in the memory, the driving voltage data of the approximate frequency stored in the memory may be used, or the driving voltage data of the driving frequency may be calculated using the proportional expression, as previous exemplary embodiments explained referring to FIGS. 4 and 5.

In addition, when the ripple compensation data is not stored in the memory, the ripple voltage data of the approximate frequency stored in the memory may be used, or the ripple voltage data of the driving frequency may be calculated using the proportional expression as previous exemplary embodiments.

According to exemplary embodiments of the inventive concept, the display panel is driven with the driving voltages which are synchronized with the driving frequency of the display panel. In addition, the ripple of the driving voltage may be optimally compensated in synchronization with the driving frequency. Therefore, when the display apparatus is driven with a low frequency in order to decrease power consumption, a display quality of an image may be improved. The foregoing is illustrative of the present inventive concept and is not to be construed as limiting the scope of the claims. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A method of generating a driving voltage which drives a display panel, the method comprising:

storing a plurality of driving voltage data corresponding to a plurality of driving frequencies of the display panel in a memory which is electrically connected to the display panel;

obtaining a frequency signal corresponding to a driving frequency of the display panel;

reading out driving voltage data corresponding to the driving frequency of the display panel from the memory according to the frequency signal; and generating the read out driving voltage data as the driving voltage of the display panel.

2. The method of claim 1, wherein the driving voltage comprises a gate on voltage and a gate off voltage which are applied to a gate driver circuit configured to drive a gate line of the display panel, an analog source voltage which is applied to a data driver circuit configured to drive a data line of the display panel.

3. The method of claim 2, further comprising:

when the driving voltage data of the driving frequency are not in the memory, reading out driving voltage data of an approximate frequency from the memory and generating a driving voltage using the driving voltage data of the approximate frequency.

4. The method of claim 3, further comprising:

reading out ripple compensation data corresponding to the driving frequency from the memory according to the frequency signal; and compensating a ripple of the driving voltage based on the ripple compensation data.

5. The method of claim 1, further comprising:

reading out ripple compensation data corresponding to the driving frequency of the display panel from the memory according to the frequency signal; and compensating a ripple of the driving voltage based on the ripple compensation data.

6. The method of claim 5, wherein the ripple compensation data is configured to compensate a ripple of the analog source voltage.

7. A method of generating a driving voltage which drives a display panel, the method comprising:

storing a plurality of driving voltage data corresponding to a plurality of driving frequencies of the display panel in a memory electrically connected to the display panel;

obtaining a frequency signal which includes a driving frequency of the display panel;

reading out driving voltage data of approximate frequencies from the memory;

calculating an incremental value using a proportional expression; and calculating driving voltage data of the driving frequency using the incremental value, wherein the driving voltage is generated using the calculated driving voltage data.

8. The method of claim 7, further comprising:

reading out ripple compensation data of an approximate frequency to the driving frequency of the display panel from the memory, wherein the ripple of the driving voltage is compensated using the ripple compensation data of the approximate frequency.

9. The method of claim 7, further comprising:

reading out ripple compensation data of approximate frequencies to the driving frequency of the display panel from the memory;

calculating an incremental value using a proportional expression; and calculating ripple compensation data of the driving frequency using the incremental value, wherein the ripple of the driving voltage is compensated using the calculated ripple compensation data.

10. A display apparatus comprising:

a display panel comprising a liquid crystal capacitor which is connected to a data line and a gate line through a thin film transistor;

a timing control circuit configured to obtain a frequency signal corresponding to a driving frequency of the display panel based on an original control signal;

a memory configured to store a plurality of driving voltage data respectively corresponding to a plurality of driving frequencies; and a power management circuit configured to generate a driving voltage of the display panel based on driving voltage data which corresponds to the driving frequency of the display panel.

11. The display apparatus of claim 10, wherein the power management circuit and the memory are integrated into one chip.

12. The display apparatus of claim 11, wherein when the driving voltage data of the driving frequency are not in the memory, the power management circuit is configured to read out driving voltage data of an approximate frequency from the memory and to generate the driving voltage based on the driving voltage data of the approximate frequency.

13. The display apparatus of claim 11, wherein when the driving voltage data of the driving frequency are not in the memory, the power management circuit is configured to read out driving voltage data of approximate frequencies from the memory, to calculate an incremental value using a proportional expression, to calculate the driving voltage data of the driving frequency using the incremental value, and to generate the driving voltage based on calculated driving voltage data.

14. The display apparatus of claim 11, wherein the memory is configured to store a plurality of ripple compensation data which are configured to compensate ripples of the plurality of driving voltage data corresponding to a plurality of driving frequencies.

15. The display apparatus of claim 14, wherein the power management circuit is configured to compensate ripples of the driving voltage of the display panel using ripple compensation data of the driving frequency of the display panel in the memory according to the frequency signal.

16. The display apparatus of claim 15, wherein the ripple compensation data are configured to compensate the ripples of an analog source voltage.

17. The display apparatus of claim 14, wherein, when a driving voltage data of the driving frequency of the display panel are not in the memory, the power management circuit is configured to read out ripple compensation data of an approximate frequency to the driving frequency of the display panel from the memory and to compensate ripples of the driving voltage of the display panel based on the ripple compensation data of the approximate frequency.

18. The display apparatus of claim 14, wherein, when a driving voltage data of the driving frequency of the display panel are not in the memory, the power management circuit is configured to read out ripple compensation data of approximate frequencies to a driving frequency of the display panel from the memory, to calculate an incremental value using a proportional expression, to calculate ripple compensation data of the driving frequency of the display panel using the incremental value, and to compensate ripples of the driving voltage of the display panel based on the calculated ripple compensation data.

19. The display apparatus of claim 10, wherein the memory and the timing control circuit are integrated into one chip.

* * * * *